United States Patent [19]

Biggs

[11] 4,002,342

[45] Jan. 11, 1977

[54] STOCK MARKET INVESTMENT GAME

[76] Inventor: Fred Conner Biggs, 751 Rosecrans St., San Diego, Calif. 92106

[22] Filed: Jan. 15, 1976

[21] Appl. No.: 649,212

[52] U.S. Cl. ..... 273/134 AE; 273/134 AF; 273/134 D; 273/134 G

[51] Int. Cl.[2] ..... A63F 3/00

[58] Field of Search ..... 273/134

[56] References Cited

UNITED STATES PATENTS

| | | | |
|---|---|---|---|
| 2,673,738 | 3/1954 | Jenkins | 273/135 C |
| 3,058,747 | 10/1962 | Nemetsky et al. | 273/134 AF |
| 3,198,521 | 8/1965 | Kramer et al. | 273/134 AF |
| 3,254,894 | 6/1966 | Kollmeyer et al. | 273/135 C |
| 3,499,646 | 3/1970 | Burgess et al. | 273/1 R |
| 3,539,189 | 11/1970 | Shelton | 273/134 AF |
| 3,765,682 | 10/1973 | Braude | 273/134 AF |

*Primary Examiner*—Delbert B. Lowe
*Attorney, Agent, or Firm*—Brown & Martin

[57] ABSTRACT

A stock market game in which dice determine the current market condition as represented by the Dow Jones Averages. The dice values of two to 12 determine the Dow Jones Averages corresponding to values between 200 and 1200. A series of stocks are associated with spaces on a top disc and stock prices on a bottom disc are visible through windows in the top disc. The top disc is divided radially into a series of recording spaces corresponding to the stock price for a given market condition. A series of game control spaces determine when the market condition is changed to a different Dow Jones Average, and results in a new market price for the individual stocks.

10 Claims, 3 Drawing Figures

STOCK MARKET INVESTMENT GAME

BACKGROUND OF THE INVENTION

Stock market games have been known for many years and have taken a great variety of forms. The various arrangements and designs have as their objective to simulate as closely as possible the circumstances involved in a realistic speculative situation.

The prior art games are deficient in that realistic market conditions are quite difficult to simulate and hense, investment strategies are difficult to formulate. This makes it difficult for the investor playing any of the prior art games to make informed investment judgments. There has been a need, therefore, to provide a stock market game that as closely as possible provides the players with an investment environment that is realistic and conducive to making reasoned investment decisions consistent with the player's particular market strategy.

SUMMARY OF THE INVENTION

In an exemplary embodiment of the invention, a game board has a continuous path divided into a plurality of playing piece spaces, each space being associated with a particular stock. A playing piece, preferably of a ferrous material, is utilized for progressing from space to space according to the number displayed by a random number generating means in the form of a pair of dice. The game is controlled by market conditions biasing means in the form of master spaces on the game board. Whenever a playing piece lands on a master space, the market condition or Dow Jones Average is changed by rolling the dice. The Dow Jones Averages vary from 200 to 1200. Since the dice display the numbers two to 12, then if the dice are displaying eight, the market condition biasing means turns to a Dow Jones Average of 800.

The game board comprises a top disc and a bottom disc, the top disc being rotatably mounted with respect to the bottom disc. The top disc includes stock price recording means in the form of a series of spaces radially defined with respect to the playing piece spaces. A player may buy or sell a particular stock only upon landing on a space associated with that stock. The purchase price of the stock is recorded by taking a second playing piece and placing it in the recording space that corresponds to the Dow Jones Average at the time of purchasing the stock. The purchase or sale price of the individual stock at a given time is determined by the number displayed on the bottom disc, as viewed through windows formed in the recording spaces in the top disc. The bottom disc is also provided with numbers representing dividends payable for each stock. The dividends are payable to the player owning the stock, when another player lands on the space associated with that particular stock. The precise dividend values are observable through windows formed in the top disc aligned with the dividend values displayed by the bottom disc.

It is, therefore, an object of the invention to provide a new and improved stock market game.

Another object of the invention is to provide a new and improved stock market game requiring skill and investment decisions.

Another object of the invention is to provide a new and improved stock market game that simulates realistic investment environments.

Another object of the invention is to provide a new and improved stock market game characterized by excitement, strategy and skill.

Other objects and many attendant advantages of the invention will become more apparent upon a reading of the following description together with the drawings, in which like reference numerals refer to like parts throughout and in which.

DETAILED DESCRIPTION OF THE DRAWINGS

Figure 1:
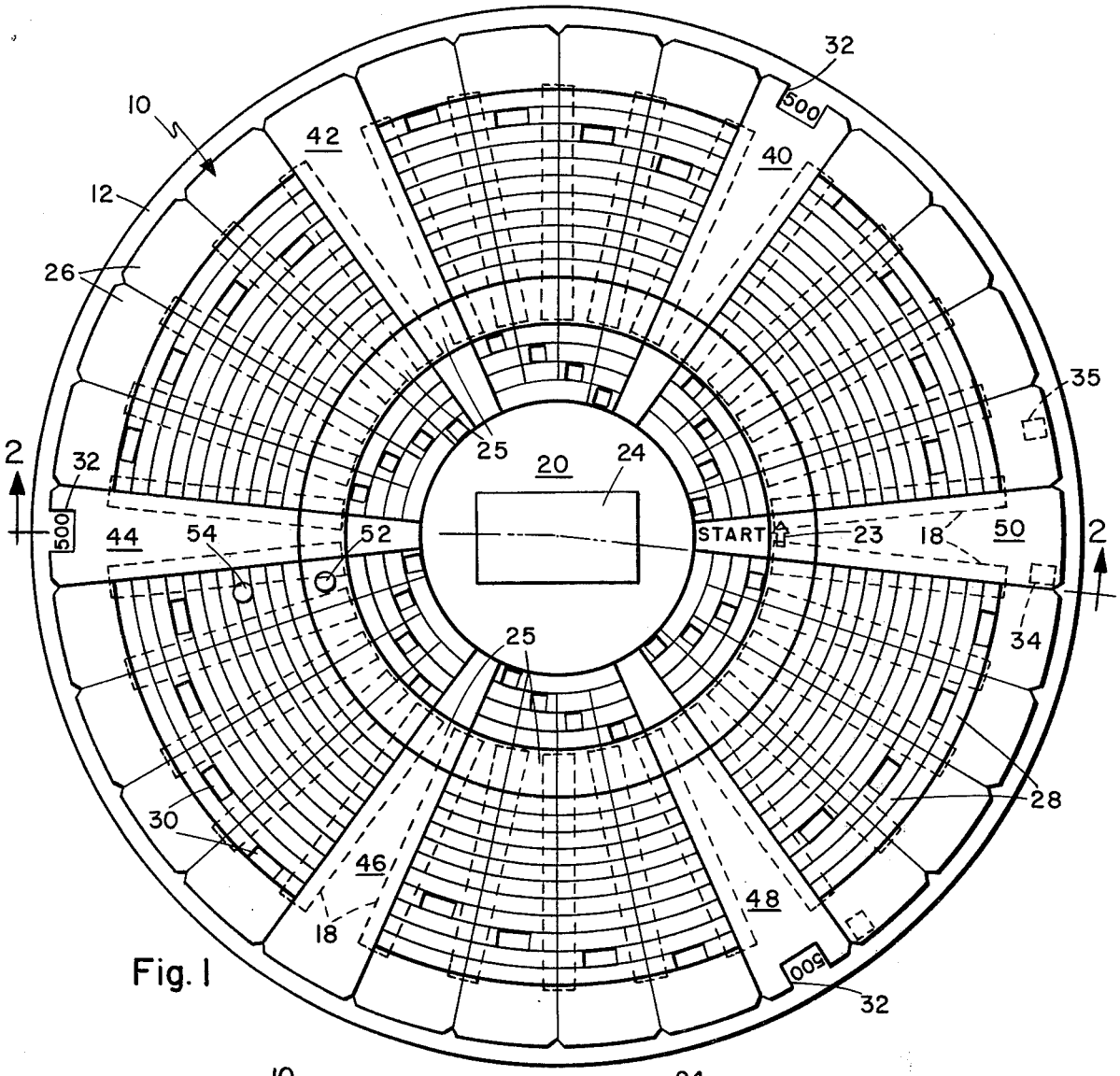
FIG. 1 is a plan view of the game of the present invention.
Figure 2:
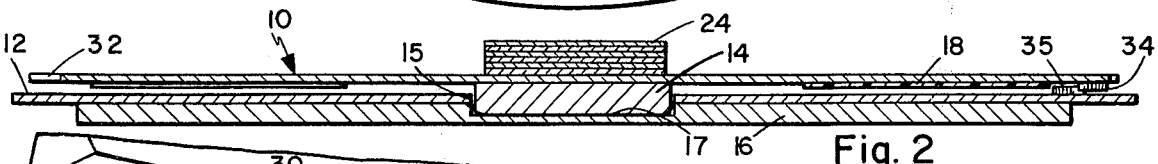
FIG. 2 is a cross-sectional view taken along the line 2—2 of FIG. 1.

In the preferred embodiment of the invention, the game board comprises a top disc 10. The top disc 10 is mounted over a bottom disc 12. The top disc 10 includes a journal 14 that is received through a hole 15 in the bottom disc and into a recess 17 in the base 16. A series of magnetic strips 18 are connected to the rear of the top disc 10. The game pieces utilized with the invention may be of any configuration, but it is preferred that they be fabricated from a ferrous material so as to be attracted to the game board to avoid being jostled from designated spaces.

Figure 3:
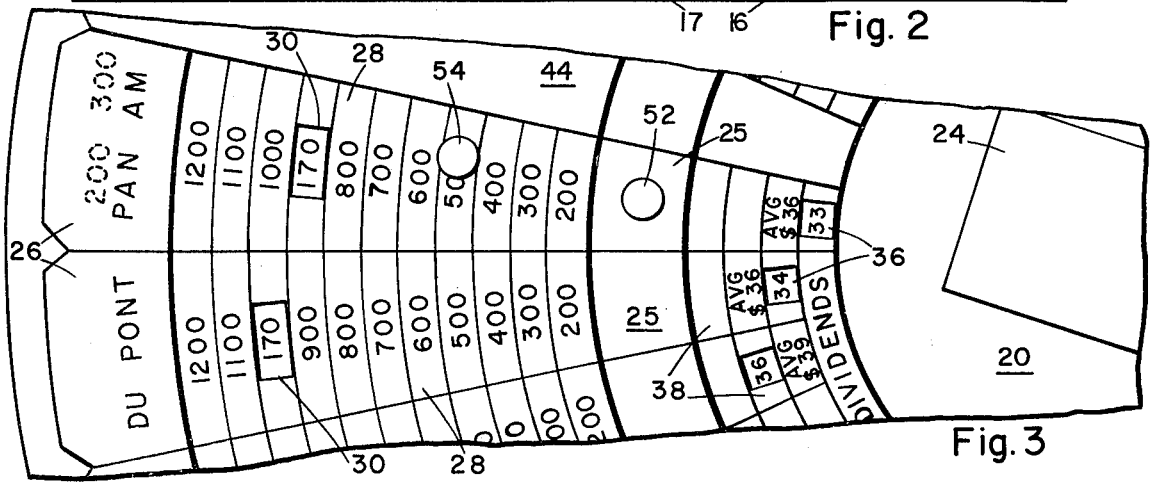
FIG. 3 is an enlarged, partial view of the game board illustrated in FIG. 1, illustrating the various Dow Jones Averages and dividends.

The top disc 10 includes a center section 20 with provision for supporting a series of instruction cards, to be hereinafter referred to as Wall Street Journal cards 24. The top disc 10 also includes a series of playing piece spaces 25 comprising a circular path. The start arrow 23 indicates the direction of progression of a playing piece. A series of stock price recording spaces 28 are associated with each of the playing piece spaces 25. The stock price recording spaces 28 are graduated by 100's from the value 200 to 1200. The values displayed in the stock price recording spaces 28 correspond to the Dow Jones Averages for a given market condition. A series of windows 30 are formed in the top disc 10, in the area defined by the stock price recording spaces 28. The windows 30 permit viewing of a particular stock price corresponding to a given market condition or Dow Jones Average. For instance, in the example illustrated in FIG. 3, the value of 170 is shown as the purchase or sell price for the stock Pan Am. A series of stock displaying spaces 26 are formed on the periphery of the top disc 10. Stops 34 and 35 are connected to the underside of top disc 10 and the top of bottom disc 12 respectively. The stops coact to limit the relative rotation between the discs. Twenty-four stocks are utilized in the preferred embodiment and are grouped in sets of four. There are dividends associated with each of the stocks utilized in the game and the values of the dividends are displayed on the bottom disc 12. The particular dividend for a given stock, corresponding to a given market condition, is viewed through a series of windows 36 formed in the top disc 10 adjacent the center section 20. The windows 36 are formed in a series of dividend spaces 38.

The top disc 10 also comprises a series of master spaces 40, 42, 44, 46, 48 and 50. The master spaces 40, 44 and 48 will be hereinafter referred to as brokerage house spaces. The master spaces 42 and 46 will hereinafter be referred to as Wall Street Journal spaces. The master space 50 represents the bank. The bank space 50 may bear instructional material such as "borrow $2,000.00 when passing" or "pay $5,000.00 when stopping". A series of notches 32 are formed in the top disc 10, in the brokerage house control spaces 40, 44 and 48. Dow Jones Averages corresponding to a given market condition are displayed on the bottom disc 12 and visible in the notches 32. In addition to defining the board by means of the radial and circumferential lines that define the various spaces previously described, the top disc 10 may be color coded. The individual groupings of stocks may be all one color, with variations of color shade for the recording spaces 28. Additionally, the master control spaces 40, 42, 44, 46 and 48 and 50 may be set out in different colors to make them clearly visible.

The strategy of the game resembles that of actually investing in the stock market. That is, to purchase stocks at the lowest possible price and to sell at the highest possible price. It is also desirable to collect dividends on stocks owned. The game is over when a particular player gains control of all of the outstanding stock and money in the game. One player may act as the banker and issues a predetermined amount of money to the individual players. The game board is initially set at the Dow Jones Average of 200 by rotating the top disc 10 until the number 200 appears in the notches 32.

Each player, in turn, throws the dice, and moves his playing piece 52 that may also be referred to as the customer's man, starting from the master space 50 and within the spaces 25. A stock may be bought or sold only when a player lands on that particular space. If the stock is unowned at the time a player lands on that space, he may purchase it from the bank at the prevailing market price as indicated in the window 30 associated with the particular stock. A second playing piece or marker 54 is then placed by the player on that particular stock in the appropriate recording space 28. The recording space 28 chosen is that corresponding to the Dow Jones Average at the time of the purchase. For instance, in the drawings, the Dow Jones Average is shown to be 500 and therefore, the second playing piece or marker would be placed in the 500 recording space for Pan Am. This would correpond to the purchase price of $170.00 per share. The function of the recording spaces 28 are as a reference so that when the stock is sold the player will know the amount of his original investment. When a player lands on a stock that he already owns, he may sell it back to the bank at the prevailing market price. When a player lands on a stock that is owned by some other player, it is required that he pay to that player dividends as displayed in the dividend window 36 associated with that particular stock. In the preferred embodiment, no more than one player may own a particular stock and all transactions are made between the players and the bank, except for the paying of dividends and exercising of options as hereinafter discussed.

The market condition is regulated by the brokerage house spaces 40, 44 and 48. Whenever a player lands on a brokerage house space, he then tosses the dice a second time to establish a new market condition or Dow Jones Average. The Dow Jones Average is then reset to correspond to the amount shown on the dice. For instance, if the dice turns up 6, the Dow Jones Industrial Average is reset to 600. This is done by rotating the top disc 10 until the value of 600 is displayed through the notches 32. This new market condition is then in effect until a player once again lands on a brokerage house space. When a player lands on one of the brokerage house spaces 40, 44 and 48, he has one of three choices. He may stay where he is and pass his turn if market conditions appear unfavorable, he may also move ahead to the first stock that is unowned and purchase it from the bank at the prevailaing market price, or he may also move ahead to the first stock that is owned by himself and sell it to the bank. The players should always be mindful of the fact that the number seven is the most common number to appear when a pair of dice are thrown. The numbers closest to seven are the next most common. For example, a two or 12 appears on the average of only once in 36 throws. Therefore, exercise of investment strategy contemplates the appearance of Dow Jones Averages between 500 and 900 as much more probable than Dow Jones Averages of between 200 and 400 or 1000 and 1200. Thus, the game closely simulates the actual historical performance of the market with averages grouping around 700.

Another strategy involved in playing the game concerns the use of purchasing stock on margin. An investor may purchase any stock on margin by paying one-half of the prevailing purchase price to the bank. Only one marker or playing piece is placed on the appropriate recording space 28 corresponding to the particular stock until it is fully paid. When the other half of the purchase price is paid, a second marker or playing piece is placed on that recording space 28. Margined stock may be paid for in full, at the original purchase price, on any subsequent turn. Margined stock has full privileges permitting the owner to collect full dividends, and receive full value when the stock is sold.

When a player lands on one of the Wall Street Journal control spaces 42 or 46, he removes a card from the card stack 24 in the center section 20. The cards may provide any instructions to increase the excitement of the game. In the preferred embodiment, the cards are divided into three types: margin calls, options and others. When a player receives a margin call card, he can retain it until he lands on another player's stock that is margined, and which he wishes to call. He may then present to the other player the card instead of paying the dividend. The player whose margin stock has been called must forfeit to the bank all of the stock held by him on margin. When a player receives an option card, he may on any subsequent turn, exercise the option by purchasing the stock he has landed on whether or not it is owned by the bank or another investor. To purchase the stock the player pays to the bank or the other player, as the case may be, one-half of the current market price of the stock. In addition to the margin call and option cards, the "other" cards may display any desired instructions, and the player receiving one of these cards must follow the instructions on the card. All the Wall Street Journal cards, once played, are then returned to the stack 24.

Whenever any player is unable to pay any debt in cash he is declared bankrupt. He may not borrow from the bank or any other player, and his remaining assets are liquidated. If the debt is owned to another investor, a merger takes place whereby the creditor takes over all of the remaining assets of the bankrupt investor, including any cash. The merger has the effect of resulting in a partnership, in which the creditor player becomes the senior partner. The debt is thus cancelled and play continues with the senior partner making all investment decisions upon consulting his junior partner or partners. If the debt is owed to the bank, the bank retains all cash and places the stock of the bankrupt investor for auction. The stock then goes to the highest bidder, who then becomes the senior partner. If there are no bidders, the bank retains all of the assets.

In the preferred embodiment of the invention, certain of the stocks have been chosen as "blue chip" stocks, so referred to because they almost always pay high dividends. Other stocks are very volatile being subject to rapid increases and decreases in value, but pay little or no dividends. Still other stocks may be moderately priced and pay moderate dividends. Therefore, the game is attractive to speculative, conservation or moderate investors. The game simulates the realities of the stock market with all of the pitfalls for the imprudent or novice investor. On the other hand, shrewd and sophisticated investors will find their just rewards by accumulating substantial amounts of cash.

Having described my invention, I now claim:

1. A game comprising:

a game board having a continuous path divided into a plurality of spaces representing individual stocks, a playing piece for progressing along said path from space to space, recording means for recording the purchase price of stock shares corresponding to the location on said path of said playing piece, said recording means comprising a series of radial spaces each marked with market condition averages, random number generating means for designating a number of spaces to be moved by said playing piece, and market conditions biasing means for adjusting the market condition average and biasing share prices of said stocks according to a number generated by said random number generator.

2. The game of claim 1 including:

means to retain said playing piece on said game board.

3. The game of claim 2 wherein:

said means to retain said playing piece comprises magnetic strips connected to the rear of said game board, and said playing piece is fabricated from a ferrous material.

4. The game of claim 1 wherein:

said game board comprises a top disc having a series of windows, said biasing means comprises a bottom disc, said top disc being rotatable with respect to said bottom disc, said bottom disc having a series of stock prices displayed thereon, a given number of said stock prices being aligned with said windows at any given market condition and said stock prices being visible through said windows, and a series of market condition averages displayed on said bottom disc visible from above said top disc.

5. The game of claim 4 including:

a series of stock designation spaces formed radially with respect to said recording means, each space representing a particular share of stock.

6. The game of claim 5 wherein:

said random number generating means comprises a pair of dice.

7. The game of claim 6 including:

dividend display means for indicating dividend values associated with a particular stock, said means comprising windows in said top disc spaced radially inwardly from said recording means.

8. The game of claim 7 wherein:

a particular stock can be bought or sold at the current market price as determined by said market condition biasing means, only when a player lands on a space associated with that particular stock, only one investor at a time may own a particular stock, and dividends are paid to a stock owner whenever another player lands on a space associated with the owned stock.

9. The game of claim 1 including:

a series of stop members connected to the bottom of the top disc and the top of the bottom disc, said stop members coacting to limit the relative rotation between said discs within desired limits.

10. The game of claim 1 wherein:

said random number generating means on the market condition averages that group around 700.

* * * * *